US005967832A

United States Patent [19]

Ploehn

[11] Patent Number: 5,967,832

[45] Date of Patent: Oct. 19, 1999

[54] HIGH SPEED CONNECTOR ASSEMBLY

[75] Inventor: Guenther Ploehn, Hamberg, Germany

[73] Assignee: 3M Innovative Properties Company, St. Paul, Minn.

[21] Appl. No.: 09/028,073

[22] Filed: Feb. 23, 1998

[51] Int. Cl.[6] ..... H01R 9/07

[52] U.S. Cl. ..... 439/497

[58] Field of Search ..... 439/497, 579

[56] References Cited

U.S. PATENT DOCUMENTS

| | | | |
|---|---|---|---|
| 4,225,207 | 9/1980 | Brandeau et al. | 339/95 |
| 4,279,074 | 7/1981 | Zell et al. | 29/866 |
| 4,558,917 | 12/1985 | Kamono et al. | 339/143 |
| 4,616,893 | 10/1986 | Feldman | 339/14 |
| 4,662,067 | 5/1987 | Abraham | 29/861 |
| 4,695,106 | 9/1987 | Feldman et al. | 439/83 |
| 4,747,787 | 5/1988 | Siwinski | 439/108 |
| 4,762,500 | 8/1988 | Dola et al. | 439/79 |
| 4,834,674 | 5/1989 | Beamenderfer et al. | 439/494 |
| 4,838,809 | 6/1989 | Mouissie | 439/155 |
| 4,875,877 | 10/1989 | Fleak et al. | 439/497 |
| 4,880,388 | 11/1989 | Beamenderfer et al. | 439/108 |
| 4,880,397 | 11/1989 | Dawson, Jr. et al. | 439/620 |
| 4,907,979 | 3/1990 | Feldman | 439/83 |
| 4,917,616 | 4/1990 | Demler, Jr. et al. | 439/101 |
| 4,973,264 | 11/1990 | Kamono et al. | 439/497 |
| 5,011,428 | 4/1991 | Heng et al. | 439/394 |
| 5,074,806 | 12/1991 | Korsunsky et al. | 439/497 |
| 5,104,329 | 4/1992 | Brown et al. | 439/108 |
| 5,116,239 | 5/1992 | Siwinski | 439/497 |
| 5,161,987 | 11/1992 | Sinisi | 439/101 |
| 5,174,782 | 12/1992 | Bogiel et al. | 439/497 |
| 5,183,405 | 2/1993 | Elicker et al. | 439/108 |
| 5,387,125 | 2/1995 | Davis et al. | 439/497 |
| 5,525,078 | 6/1996 | Springer | 439/610 |
| 5,536,179 | 7/1996 | Olsson et al. | 439/108 |
| 5,902,147 | 5/1999 | Jochen et al. | 439/497 |

FOREIGN PATENT DOCUMENTS

| | | | |
|---|---|---|---|
| 0 196 977 | 1/1986 | European Pat. Off. | H01R 23/68 |

OTHER PUBLICATIONS

Circuit Assembly Corporation of Irvine, CA, U.S.A. Product Catalog Part No. CA–40ATAS–C–101 Released to Production Aug. 1997. Available from the internet: URL:http://www.circuitassembly.com/catalog/ca–40atas.htmlXP002079426.

"Revolutionary Interconnect Increases Data Transfer Speeds and Eliminates Signal Crosstalk" by Ian M. Morrell, Circuit Assembly Corp., Dec. 1, 1997.

"IDE/ATA 80–Conductor Cable Eliminates Crosstalk" by Ian Morrell, pbulished in *Nikkei Electronics Asia*, Jan. 1998.

"Ultra ATA Bus: Connectors & Cable Assemblies" Product brochure for AMP, Jun. 1997.

"SFF–8049 Specification for 80–conductor ATA Cable Assembly", Rev. 2.5, Wagner, et al. (SFF Committee), Mar. 31, 1998.

"OTOS Interconnect" Product brochure for Circuit Assembly Corp. (no date).

*Primary Examiner*—Paula Bradley
*Assistant Examiner*—Katrina Davis
*Attorney, Agent, or Firm*—Matthew B. McNutt

[57] ABSTRACT

A connector for use with a ribbon cable grounds alternate conductors of a fine pitch ribbon cable, and allows selected conductors associated with the connector signal contacts to be grounded. The connector is readily adaptable to differing grounding configurations. The connector includes a plurality of signal contacts housed within an insulative body. The signal contacts electrically connect to alternate individual conductors (the "signal conductors") of the ribbon cable. A first ground bus is electrically connected to the conductors of the ribbon cable which are not connected to a signal contact (the "ground conductors"). A second ground bus electrically connects selected conductors of the signal conductors with the ground conductors. By altering the second ground bus, the grounding scheme of the connector can easily and quickly be altered. A latching cover is provided for securing the ribbon cable to the connector body and against the signal contacts, the first ground bus and the second ground bus.

24 Claims, 11 Drawing Sheets

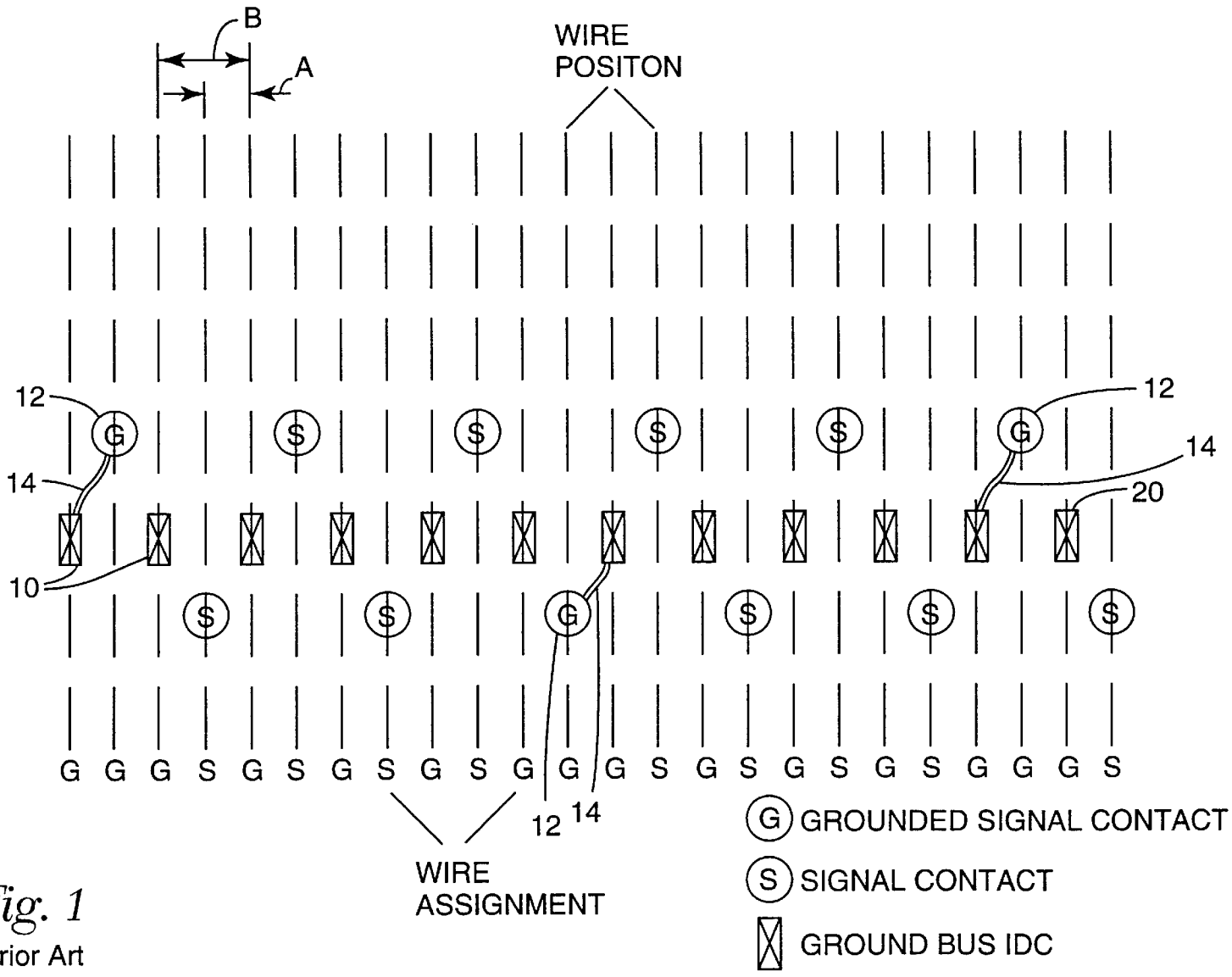
WIRE POSITON
A
B
12
14
10
20
G S G S G S

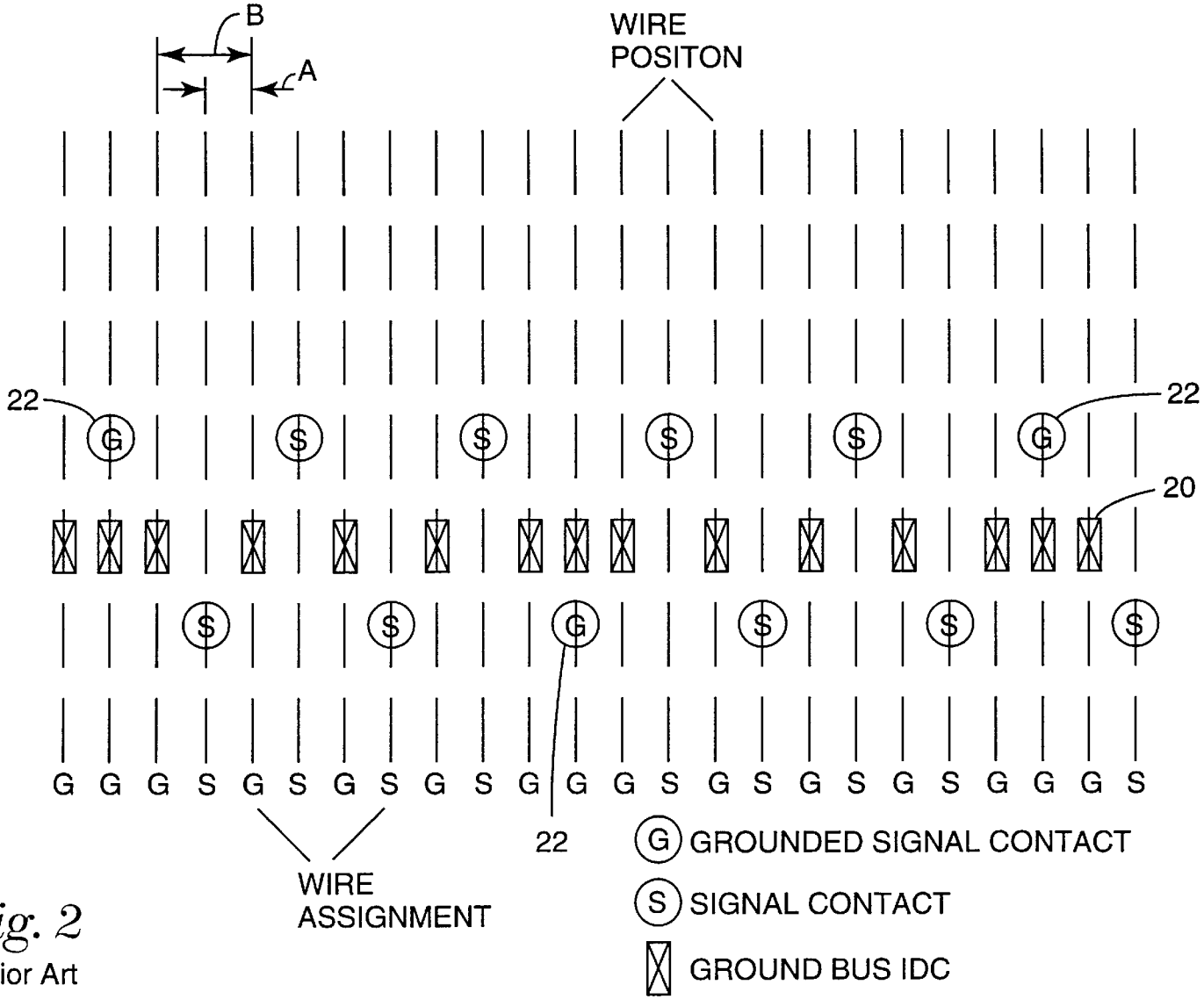
WIRE POSITON
B
A
22
20
22
22
G S G S G S

HIGH SPEED CONNECTOR ASSEMBLY

BACKGROUND OF THE INVENTION

The present invention relates to electrical connectors for use with flat multi-conductor ribbon cables, and particularly to connectors compatible with high-speed data transmission.

In modern electronic systems, such as computer systems, flat multi-wire cables (ribbon cables) are commonly used to carry signals to and from printed circuit boards, disk drives, and the like. As the speed of data transmission in electronic systems increases, the problem of crosstalk between adjacent signal wires of the ribbon cable increases dramatically. Crosstalk results from electromagnetic interference and can cause reduced signal clarity, including damage to the integrity of the data being transmitted.

To combat the problem of crosstalk, the preferred connector and ribbon cable assembly for high-speed signal transmission is a configuration that provides a ground-signal-ground (G-S-G) wire configuration. In this manner, signal wires are separated by at least one ground wire, which thereby reduces or eliminates crosstalk and enables higher speed signal transmission without significant signal degradation.

In a conventional connector, each wire of the ribbon cable is connected to a signal contact in the connector, and desired signal contacts (and associated wires) are grounded. Thus, in a conventional connector each ground wire requires a corresponding grounded signal contact within the connector body. This arrangement reduces the number of contacts in the connector available for signal transmission. In other words, to provide the preferred ground-signal-ground wire configuration, about one-half of the contacts in the connector are dedicated for grounding, thus leaving only the remaining one-half of the contacts in the connector for signal transmission. This means that for a required number of signal lines, the number of contacts in a connector (and thus the size of the connector) must be increased to accommodate the additional ground lines, unless a novel connector design is developed.

The art is replete with connectors for terminating ribbon cables. As is common in the electronics industry, standardized connector specifications (often referred to as form factors) have evolved for specific applications to ensure the compatibility of components which originate from different manufacturers. A well known standardized connector used with ribbon cables is the AT attachment (ATA) interface. The ATA interface, as originally designed, utilizes a 40 pin connector and is used to terminate a 40 conductor ribbon cable. The wire configuration of the original ATA interface is not ground-signal-ground, meaning that the signal wires are not separated by ground wires. Thus, the original ATA design is susceptible to crosstalk as data transmission speeds increase.

As the electronics industry has continued to develop systems that operate at higher and higher speeds, the ATA interface has been pushing the limits of reliable performance at transmission speeds of 33 Mbytes/s. Because the introduction of devices with transmission speeds of 66 Mbytes/s and higher is imminent, changes to the ATA interface standard have been made by the Small Form Factor (SFF) Committee. The new SFF standard, SFF-8049, retains the existing 40 pin connector interface, but replaces the original 40 conductor ribbon cable with an 80 conductor ribbon cable. The new SFF standard requires that the ground connections all occur within the same 40 pin form factor of existing ATA connectors. To retain the existing size and grounding configuration of the 40 pin connector, the 80 conductor ribbon cable has a pitch of 0.025 inch, which is one half of the 0.050 inch pitch of the earlier 40 conductor cable. This means that the distance between the wires of the 80 conductor cable is only one half of the distance between the wires of the 40 conductor cable. Alternating wires of the 80 conductor ribbon cable are connected to the grounded signal contacts of the ATA interface such that ground wires are interposed between each signal wire to minimize crosstalk and the associated signal degradation. Obviously, because only 40 signal contacts are present in the connector, each grounded conductor cannot have its own grounded signal contact. Therefor, new and unique connector designs are required to ground the additional wires of the 80 conductor ribbon cable within the 40 pin connector form factor.

Others have developed connectors for this purpose. For example, Circuit Assembly Corporation of Irvine, Calif., USA, manufactures a connector (available under the part number CA-40ATAS-C-X01) which utilizes a ground bus located inside the connector between the two rows of traditional insulation displacement contacts (IDC). A schematic representation of a portion of the Circuit Assembly connector is shown in FIG. 1. The ground bus utilizes insulation displacement contacts 10 placed on a 0.050 inch pitch to mass-terminates every other conductor of the 80 conductor ribbon cable. The grounded signal contacts 12 of the 40 pin ATA interface are electrically connected to the ground bus by conductive wipers 14 which extend between the ground bus and the grounded signal contacts 12. While the Circuit Assembly connector performs adequately, it has several disadvantages. The primary disadvantage is that the wiper contact between the ground bus and the selected grounded signal contacts is susceptible to damage during the assembly process and performance degradation over time due to surface corrosion which develops at the wiper-contact junction. Further, because the ground bus is inserted into connector housing between the signal contacts, molding the housing and assembling the components is difficult, due to the close proximity of the housing cavities which receive the signal contacts and the ground bus. The Circuit Assembly connector also has the disadvantage of being dedicated to a specific wire configuration. That is, if it is necessary to change the signal/ground wire configuration (for example, due to a form factor alteration or for a different connector application), an entirely new housing must be molded and a new ground bus designed with relocated wipers for making electrical connection to the connector contacts.

AMP Incorporated of Harrisburg, Pa., USA, manufactures a connector similar to the above described Circuit Assembly connector. Like the Circuit Assembly connector, the AMP connector (available under the part number 120605-X) utilizes a ground bus located inside the connector between the two rows of traditional insulation displacement contacts (IDC). A schematic representation of a portion of the AMP connector is shown in FIG. 2. The ground bus uses insulation displacement contacts 20 to mass-terminates every other conductor of the 80 conductor ribbon cable. In addition, the ground bus also terminates the wires associated with the grounded signal contacts 22. This means that at certain locations the AMP ground bus must terminate adjacent wires of the 80 conductor cable, which are spaced only 0.025 inch apart. This presents a disadvantage for the AMP ground bus, because it is very difficult to manufacture insulation displacement contacts at such a small pitch. As a result, certain design compromises must be made which decrease the reliability of the connections made by the ground bus. For example, as the pitch of the IDC features decreases, the amount of material available to form the IDC decreases, which in turn can affect the compliance of the IDC. If the compliance of the IDC is inadequate, the connection may fail over time as thermal cycling of the connector occurs. An illustration of an insulation displacement contact 30 for use with conductors 32 having a 0.050 inch pitch is shown in FIG. 3A, while an illustration of an insulation displacement connector 34 for use with conductors 36 having a 0.025 inch pitch is shown in FIG. 3B. The IDC 34 of FIG. 3B is less compliant than the IDC 30 of FIG. 3A, due to the presence of conductor 36', which reduces the ability of IDC arms 37 to flex. The IDC 34 of FIG. 3B is thus not as reliable and more susceptible to damage than the IDC 30 of FIG. 3A. It is therefor preferred to avoid the use of insulation displacement connectors like that shown in FIG. 3B.

Adaptability of the connector design is especially important in light of the new ATA interface standard. The ATA interface and cable assembly connects the motherboard to two devices, which could, for example be a disk drive or a CD-ROM drive. The original standard allowed any connector to be connected to either device or to the motherboard. This is not true with the revised standard, which requires that the grounding scheme of each connector be individualized to a specific location, such that the connectors for the motherboard, the first device, and the second device cannot be substituted for each other.

Therefore, it would be very beneficial to provide a connector which reliably grounds alternate wires of a fine pitch ribbon cable, which also allows selected wires associated with the connector signal contacts to be grounded, which is easily manufactured and assembled, and which is readily adaptable to differing wire configurations at minimal cost.

SUMMARY OF THE INVENTION

The present invention is a connector for use with a multi-conductor ribbon cable. The connector provides a design which reliably grounds alternate conductors of a fine pitch ribbon cable, and which easily allows selected wires associated with the connector contacts to be grounded. The connector is readily adaptable to differing wire grounding configurations.

The connector includes a plurality of signal contacts positioned within an insulative body. The signal contacts are aligned in a row within the connector body, and are adapted to electrically connect to individual conductors of the ribbon cable. An insulation displacement contact (IDC) is the preferred method of connection to the conductors of the ribbon cable, although other methods would work and are contemplated by the inventor. A first ground bus and a second ground bus are positioned adjacent the row of signal contacts. The first and second ground buses are both adapted to electrically connect to individual conductors of the ribbon cable. Again, an insulation displacement contact is the preferred method of connection. A latching cover is provided for securing the ribbon cable to the connector body and against the IDC features of the signal contacts, the first ground bus and the second ground bus.

The IDC features of the signal contacts are positioned such that every other conductor of the ribbon cable is connected to a signal contact (the "signal conductors"). The IDC features of the first ground bus are positioned such that the conductors of the ribbon cable which are not connected to a signal contact are connected to the first ground bus (the "ground conductors"). Thus, each conductor of the ribbon cable is connected either to a signal contact or to the first ground bus, but not to both. The IDC features of the second ground bus are then positioned such that selected conductors of the signal conductors are electrically connected to the ground conductors. By changing the position of the IDC features on the second ground bus, the grounding scheme of the connector can easily and quickly be altered.

In a preferred embodiment, the first and second ground buses are positioned within grooves of an insulative carrier, such that the IDC features of the signal contacts are positioned between the IDC features of the first ground bus and the second ground bus. The carrier also aids in aligning the IDC features of the signal contacts and the first and second grounding buses for accurate connection to the ribbon cable.

In an alternative embodiment, the second ground bus is a plurality of ground jumpers, rather than a single continuous strip.

BRIEF DESCRIPTION OF THE DRAWINGS

FIG. 1 is a schematic representation of a prior art connector.

FIG. 2 is a schematic representation of a prior art connector.

DETAILED DESCRIPTION OF THE INVENTION

The present invention is described herein with respect to a disk drive cable assembly. However, those skilled in the art will readily recognize that novel and inventive concepts described below may be used in other electrical connector applications. Accordingly, the specific application described herein is provided as a non-limiting example only.

Figure 3A:
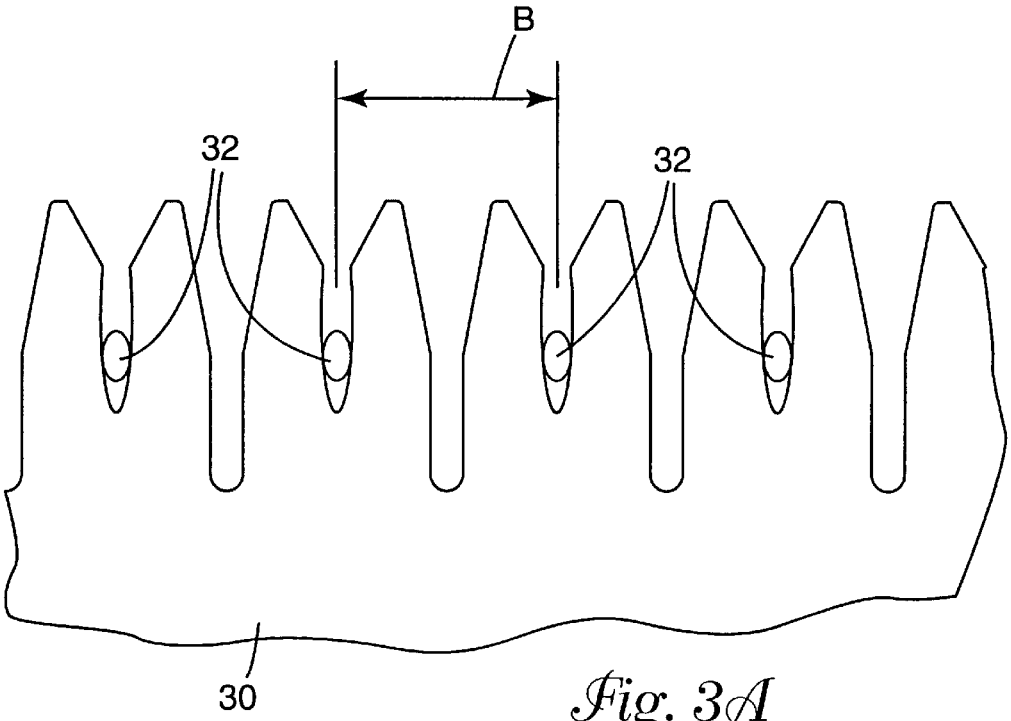
Fig. 3A Prior Art
FIG. 3A illustrates a greatly enlarged section of an insulation displacement connector (IDC) as commonly used in the art.
Figure 3B:
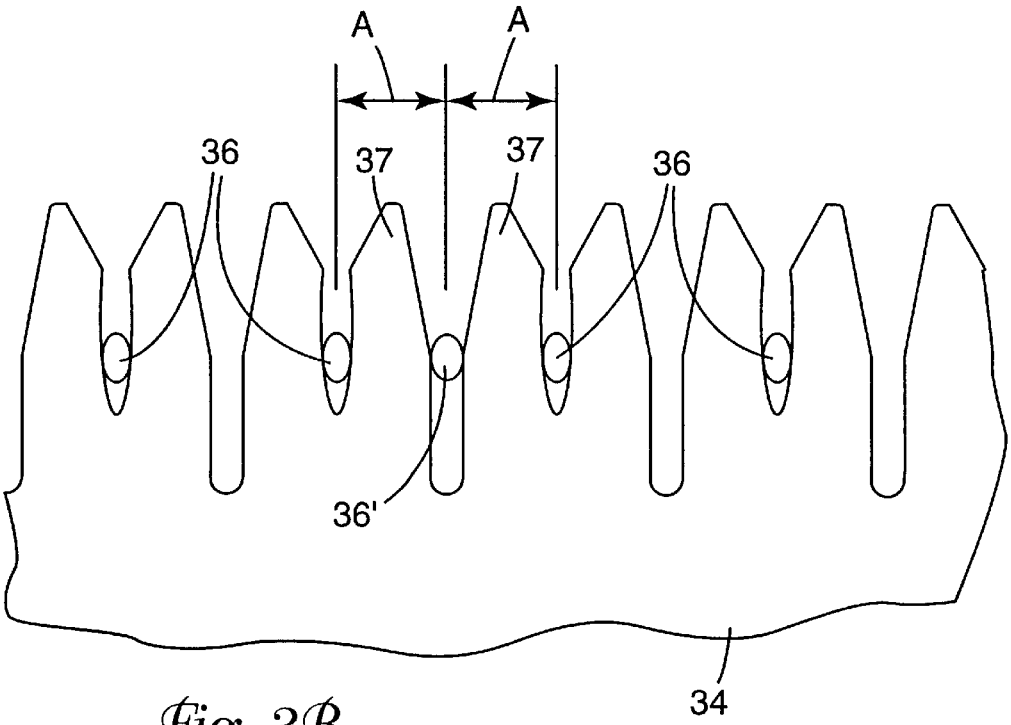
Fig. 3B Prior Art
FIG. 3B illustrates a greatly enlarged section of an insulation displacement connector (IDC) as used in the prior art connector of FIG. 2.
Figure 4:
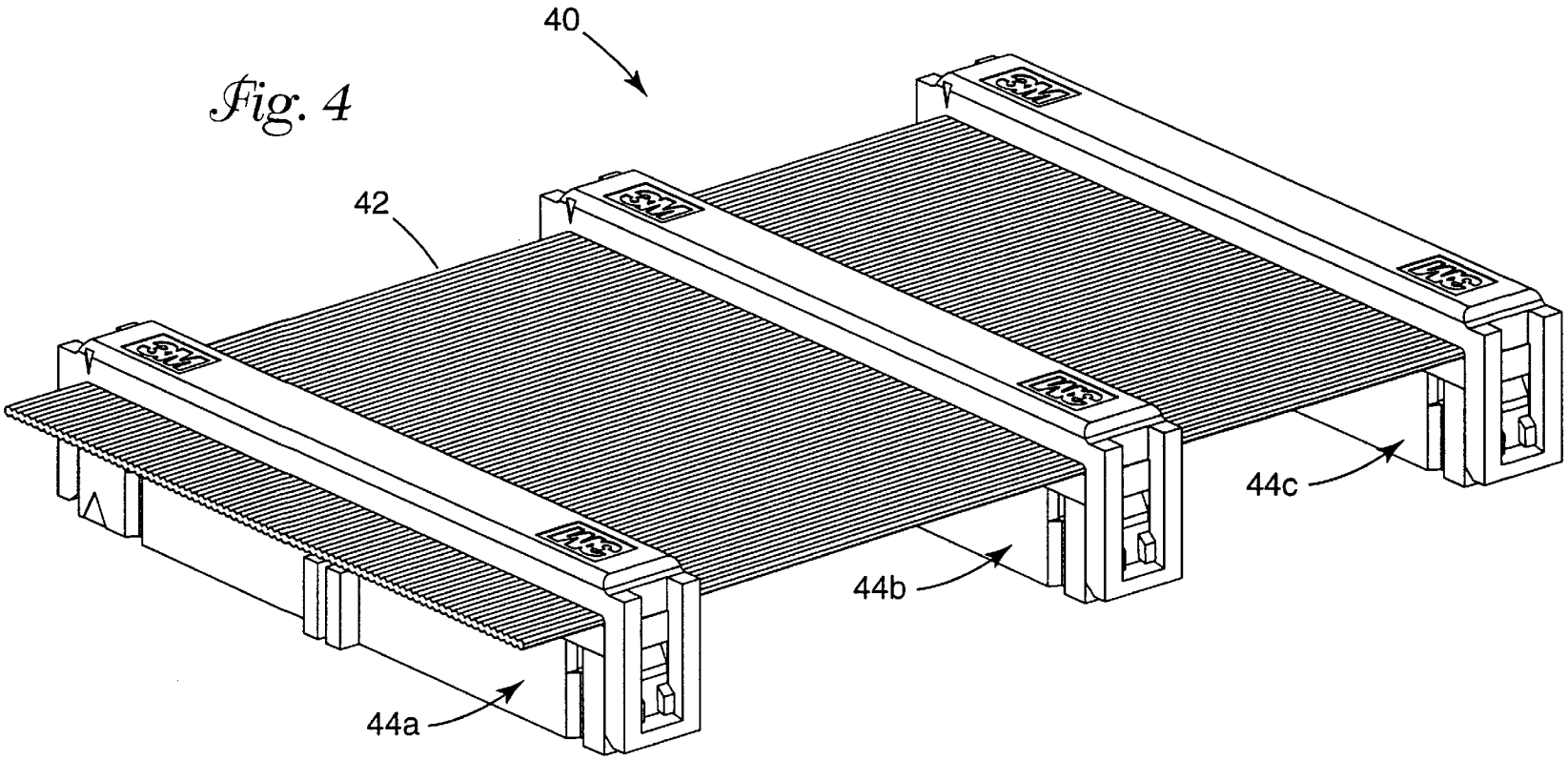
FIG. 4 is an isometric view of a disk drive cable assembly using the inventive connector described herein.

A high performance disk drive cable assembly 40 utilizing the inventive connector is shown in FIG. 4. The cable assembly 40 includes a flat multi-conductor ribbon cable 42 to which are attached three connectors 44*a*, 44*b*, 44*c*. In the example used herein, cable 42 is an 80 conductor ribbon cable having a pitch of 0.025 inch.

Connector 44*a* mates to the system motherboard, connector 44*b* mates to the slave disk drive, and connector 44*c* mates to the master disk drive. Each of connectors 44*a,* 44*b,* and 44*c* are of essentially the same construction, differing only in the grounding scheme of the connections they make to individual conductors of ribbon cable 42. The manner in which the connections to the individual conductors may be altered within the connector will be described below.

Figure 5:
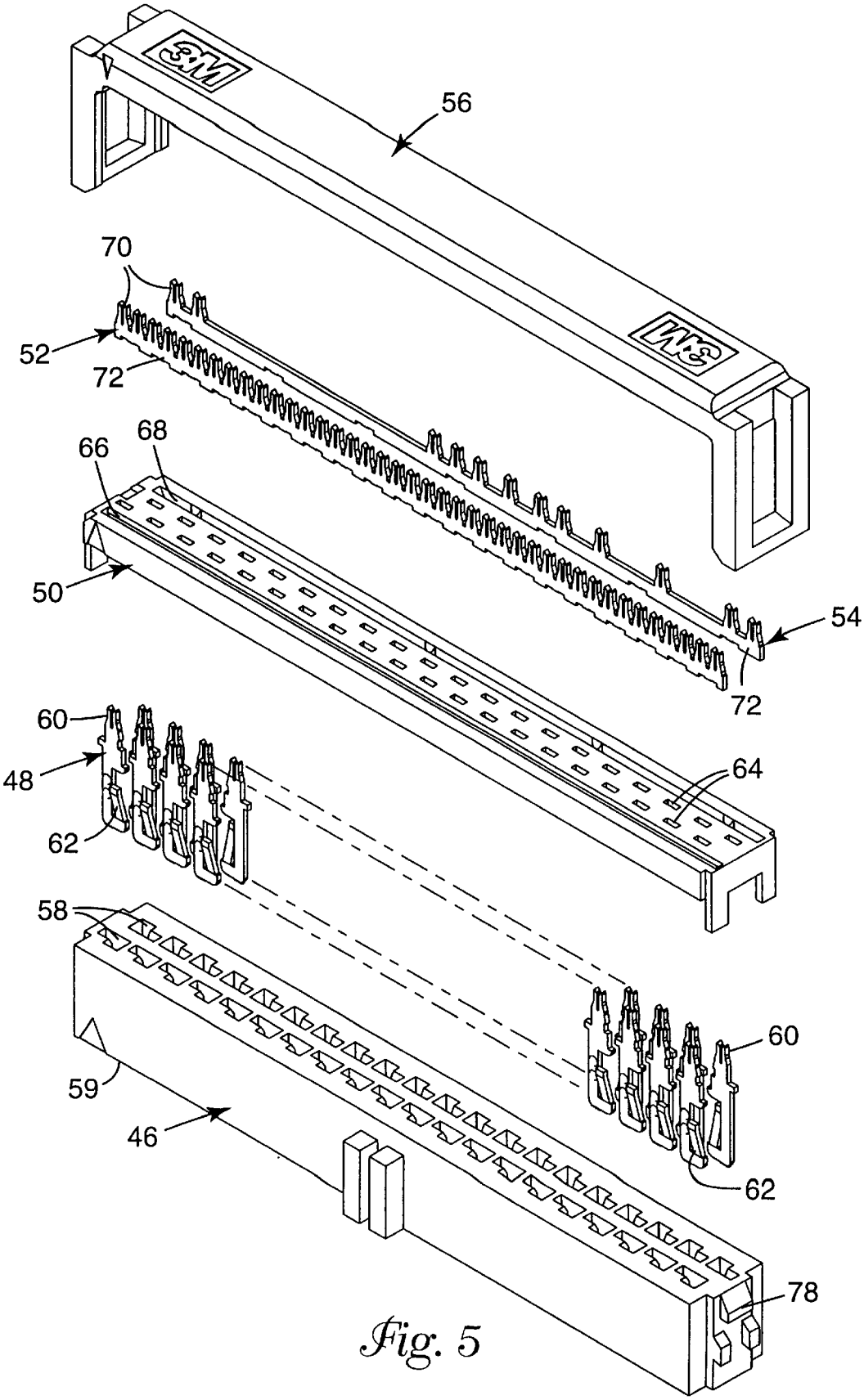
FIG. 5 is an exploded isometric view of the inventive connector described herein.

As shown in FIG. 5, each connector 44 includes a body 46, signal contacts 48, ground bus carrier 50, a first ground bus 52, a second ground bus 54, and a cover 56. Body 46 is formed of a suitable non-conductive material, for example by molding, or by any other suitable means. Body 46 includes contact receptacles 58 that extend through body 46 and that receive signal contacts 48. Signal contacts 48 electrically connect with mating pins (not shown) which are inserted into receptacles 58 from the bottom 59 of body 46.

Signal contacts 48 include an IDC (insulation displacement contact) feature 60 to terminate a single conductor of cable 42. Signal contacts 48 are further provided with a pin wipe 62 for making contact with a pin not shown) which is inserted into the connector 44. Those skilled in the art will recognize that contacts 48 may alternately be designed with a double pin wipe, a ribbon-type wipe, or any other conventionally known design for making contact with a pin that is inserted into body 46. Signal contacts 48 are positioned in contact receptacles 58 such that IDC features 60 of signal contacts 48 are arranged in two offset rows. In this manner, when signal contacts 48 are inserted into receptacles 58, IDC features 60 on signal contacts 48 have a pitch which is twice the pitch of cable 42 (a spacing of 0.050 inch in the example) and are therefor positioned to connect to every other conductor of cable 42.

Figure 6:
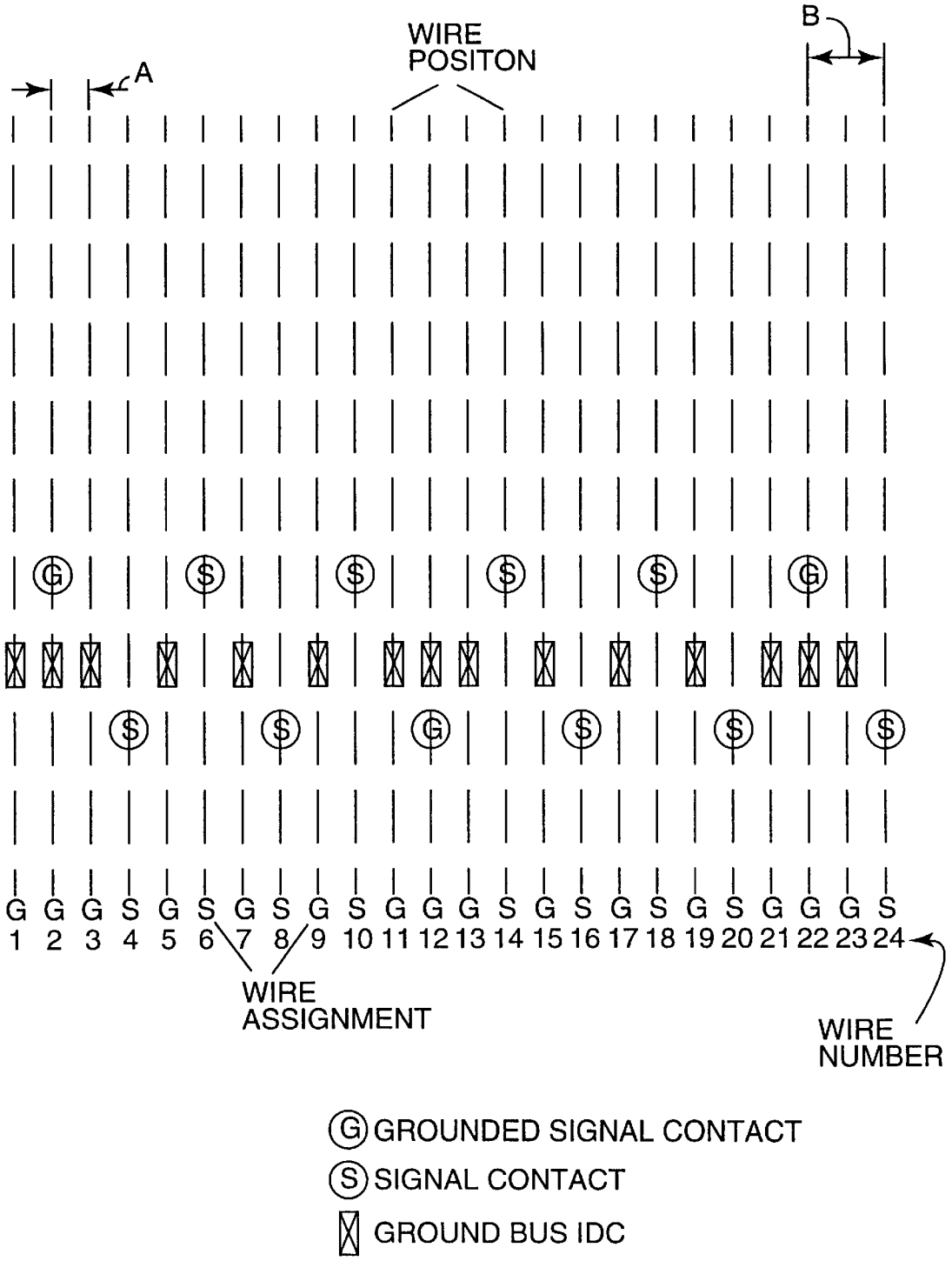
FIG. 6 is a schematic representation of the inventive connector described herein.

The arrangement of signal contacts 48 and the grounding scheme of connector 44 is shown schematically in FIG. 6. It can be seen that some signal contacts 48 are grounded. The grounded signal contacts are assigned by the relevant industry standard. FIG. 6 also shows the wire assignments for a portion of cable 42. As can be seen in FIG. 6, the signal wires S are separated by ground wires G, and there are areas in which two or more ground wires G are positioned immediately adjacent each other.

Ground bus carrier 50 is made of a non-conductive material and includes two rows of through-holes 64. Through-holes 64 are positioned to allow the IDC feature 60 of signal contacts 48 to protrude through carrier 50 when carrier 50 is assembled on top of body 46. The size of through-holes 64 is designed to provide a snug fit with the signal contacts 48, and thereby and guide the signal contacts 48 to the proper position and prevent signal contacts 48 from bending or buckling during the cable termination process. Ground bus carrier 50 further includes a first slot 66 and a second slot 68 positioned on either side of through holes 64. First and second slots 66, 68 receive first ground bus 52 and second ground bus 54, respectively.

First ground bus 52 and second ground bus 54 are formed of a conductive material and each have IDC features 70 attached to a common base 72. IDC features 70 on first ground bus 52 are regularly spaced along the entire length of ground bus 52. The IDC features 70 are spaced at twice the pitch of cable 42, such that first ground bus 52 contacts every other conductor of cable 42. First ground bus 52 is positioned within first slot 66 of carrier 50 such that IDC features 70 of first ground bus 52 contact only the conductors which are not contacted by signal contacts 48. This arrangement is best illustrated in the schematic representation of FIG. 6.

Second ground bus 54 may have multiple IDC features 70, but the IDC features 70 on second ground bus 54 are not placed at even and regular intervals like the IDC features on first ground bus 52. The IDC features 70 of second ground bus 54 are spaced apart by whole multiples of the pitch of cable 42 (e.g., 0.050 inches, 0.075 inches, 0.100 inches, etc., for the example of a cable with a 0.025 inch pitch), but are not necessarily evenly spaced along the length of second ground bus 54. IDC features 70 on second ground bus 54 are positioned to align with a conductor which is also in contact with first ground bus 52, and to align with a conductor which is also terminated by a grounded signal contact.

Figure 7A:
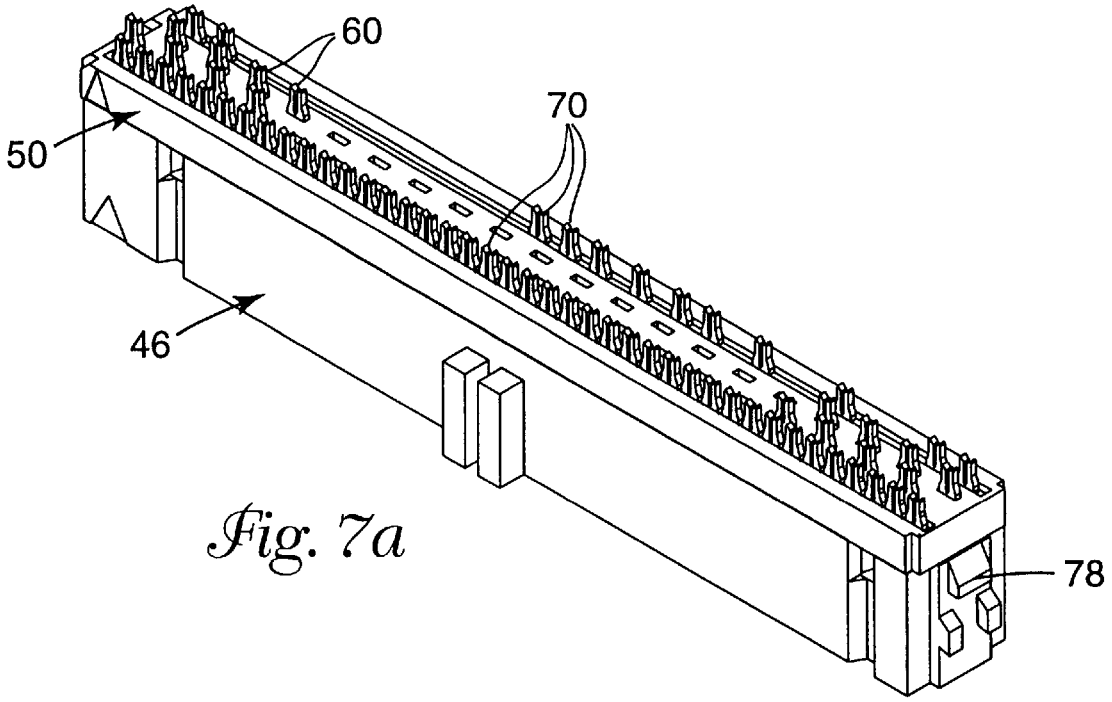
FIG. 7A is an isometric view of a partially assembled connector.
Figure 7B:
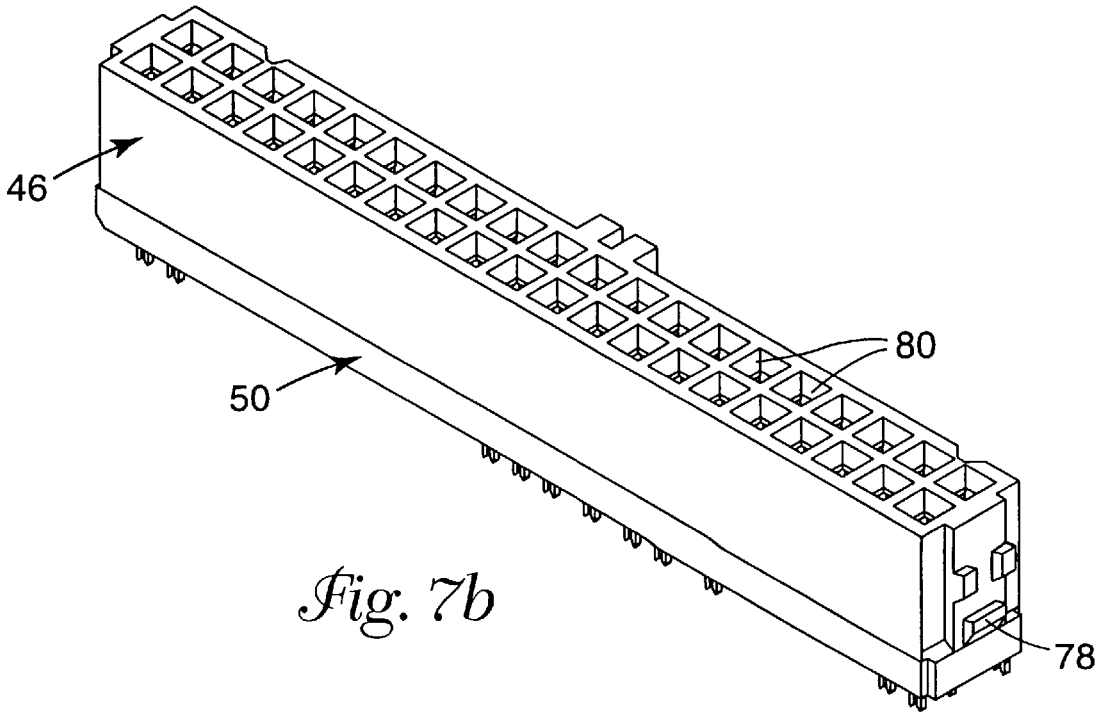
FIG. 7B is an isometric view of the opposite side of the partially assembled connector of FIG. 7A.

FIGS. 7A and 7B show body 46, signal contacts 48, ground bus carrier 50, first ground bus 52 and second ground bus 54 in an assembled condition. FIG. 7A shows the signal contact IDC features 60 and ground bus IDC features 70 extending above the surface of carrier 50, such that the IDC features 60, 70 may engage individual conductors of cable 42. FIG. 7B shows the side of the connector opposite IDC features 60, 70, and clearly illustrates pin receiving apertures 80 on bottom 59 of the connector It should be noted that, for clarity purposes, not all signal contacts are shown in the connector.

The arrangement of signal contacts 48, first ground bus 52 and second ground bus 54 is best seen by examining FIG. 6, where the wires have been consecutively numbered for easy reference. In the figure, signal contacts 48 connect to the even numbered wires, with the signal contacts on wires 2, 12 and 22 designated as ground. First ground bus 52 connects to the odd numbered wires and commons those wires, but does not connect to the signal contacts which have been designated as ground (e.g., wires 2, 12 and 22). The IDC features of second ground bus 54 are positioned to connect to the grounded signal contacts (wires 2, 12 and 22), as well as to wires 9 and 19 (which are commonly joined by first ground bus 52). Thus, second ground bus 54 effectively forms a jumper between the grounded signal contacts and the wires which are commoned by first ground bus 52. Although the row of signal contacts 48 is illustrated as being positioned between first ground bus 52 and second ground bus 54, ground buses 52, 54 could also be positioned on the same side of the row of signal contacts 48, or between signal contacts 48, for example. It should be recognized that the grounding scheme shown in FIG. 6 is provided to illustrate the relationship of the connector components with respect to the wires of cable 42. It will readily be recognized that the connector described herein can be adapted for any number of grounding schemes.

Figure 8:
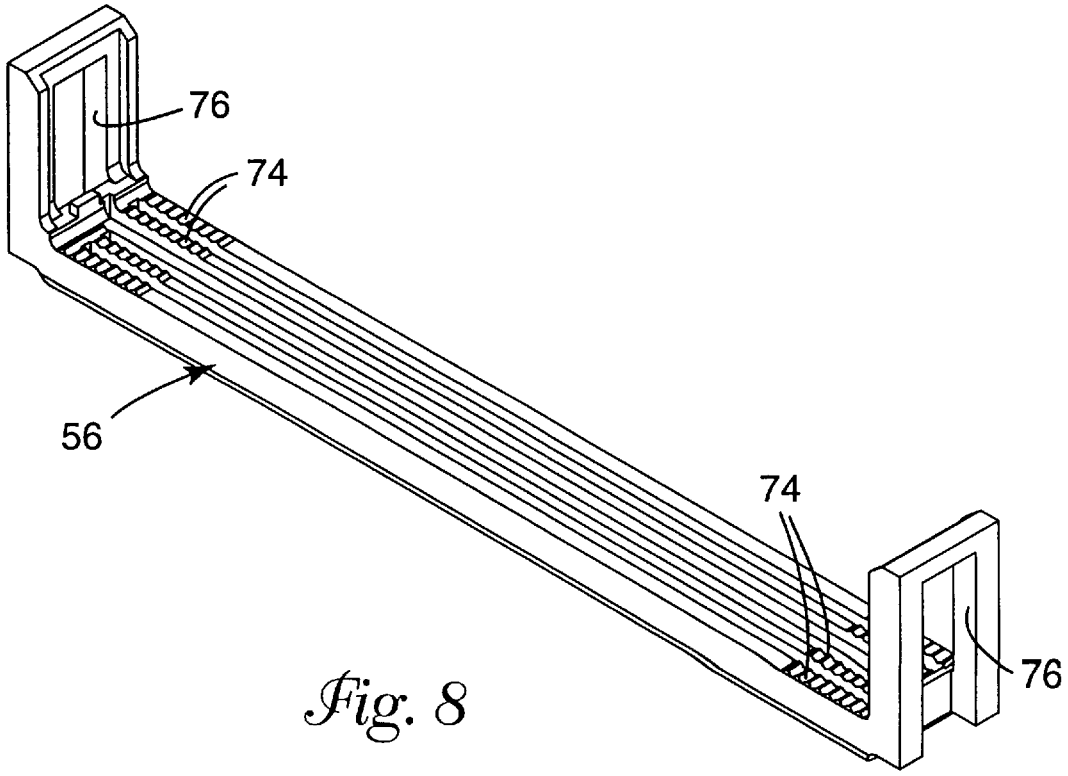
FIG. 8 is an isometric view of the cover of the inventive connector described herein.
Figure 9:
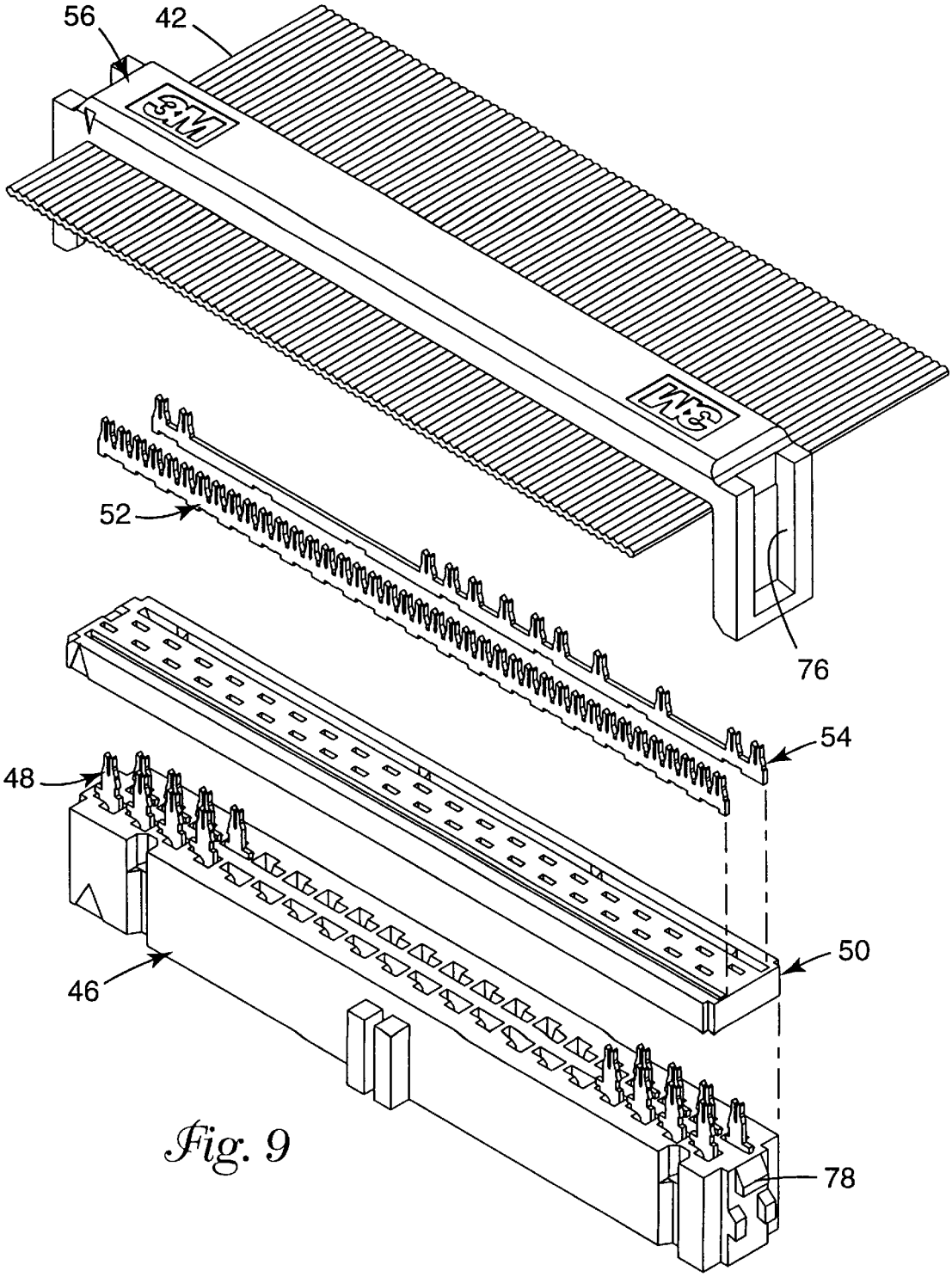
FIG. 9 is an isometric view of a partially exploded connector.

Cover 56 performs several functions. Cover 56 helps properly position cable 42 relative to the IDC features of signal contacts 48 and first and second ground bus 52, 54, secures the connector to cable 42 after termination, and provides strain relief to cable 42. As best seen in FIG. 8, cover 56 preferably has grooves 74 which align with the individual conductors of cable 42 and aid in properly aligning cable 42 with the IDC features. It should be noted that although grooves 74 are shown on only a portion of cover 56 in FIG. 8, grooves 74 may extend over the entire length of cover 56. Cover 56 also includes latch tabs 76 which interlock with mating latch tabs 78 on body 46 when connector 44 is secured to cable 42. FIG. 9 illustrates the relationship of cable 42, cover 56 and the remainder of the components of connector 44 prior to final assembly. It should be noted that some signal contacts 48 are omitted from FIG. 9 for clarity purposes.

Figure 10:
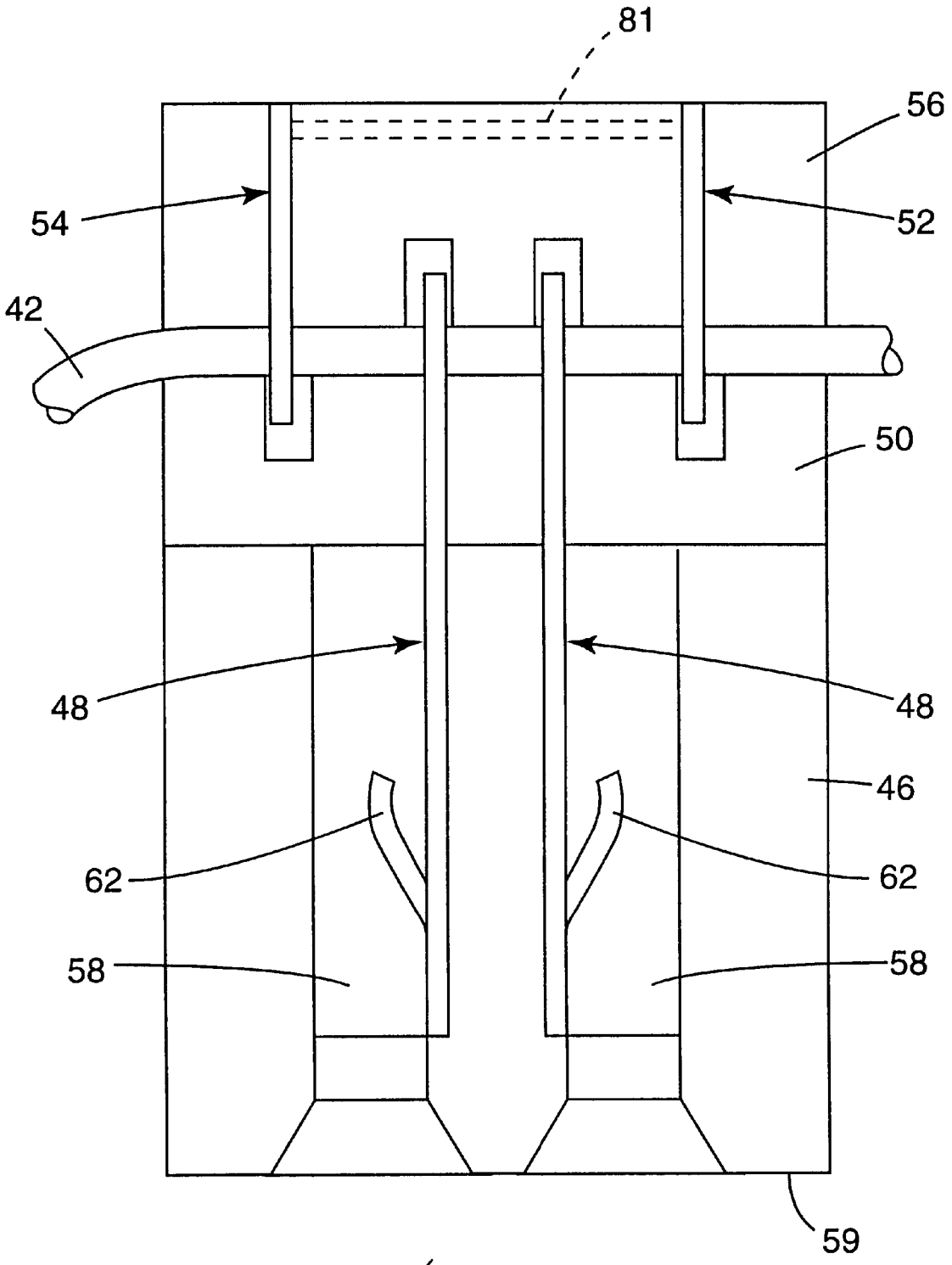
FIG. 10 is a schematic view of an alternative embodiment of the inventive connector.

In an alternate embodiment, ground buses 52, 54 could be positioned in cover 56, rather than in carrier 50. A schematic illustration of such an embodiment is shown in FIG. 10. As also shown in FIG. 10, first ground bus 52 and second ground bus 54 could optionally be connected via conductive bridge 81.

Figure 11:
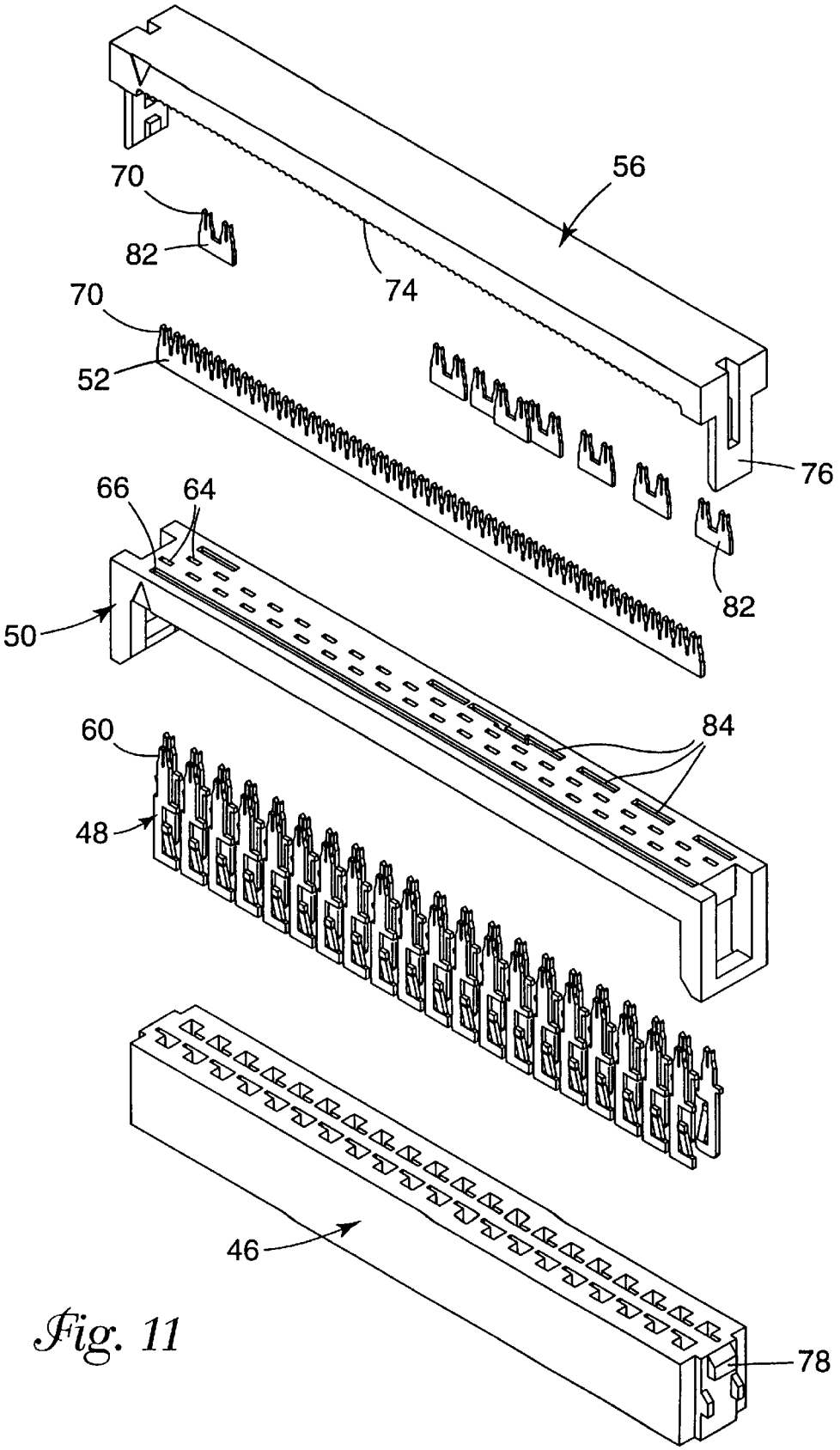
FIG. 11 is an isometric view of an alternative embodiment of the inventive connector.

In an alternate embodiment, it is contemplated that second ground bus 54 could be replaced with a plurality of ground bus jumpers 82, as illustrated in FIG. 11. In this embodiment, the IDC features 70 of the ground bus jumpers 82 are spaced on a pitch which is an odd multiple of the pitch of cable 42 (e.g., 0.075 inches, 0.125 inches, etc., in the example given), such that ground bus jumper may connect a conductor of cable 42 which is commoned by first ground bus 52 to one of the grounded signal contacts. This embodiment has the advantage of being able to use identical ground bus jumpers 82 in a variety of connector grounding schemes, rather than altering the configuration of second ground bus 54 as described above. Instead, the placement of slots 84 in carrier 50 are altered to properly position the ground bus jumpers 82. Thus, depending upon which is more cost effective, when a change in the grounding scheme is required a manufacturer may choose to utilize a common carrier 50 and alter second ground bus 54 (as described in the first embodiment), or to use a common ground bus jumper 82 and alter the position of slots 84 in carrier 50 (as described in the alternate embodiment.

The unique and inventive connector described above provides numerous advantages. It is not necessary to form IDC features on first and second ground bus 52, 54 an ground bus jumper 82 any closer than twice the pitch of cable 42, thereby eliminating the problems associated with such closely spaced IDC features. Also, by simply changing the design of one component (second ground bus 54 in the first embodiment and carrier 50 in the alternate embodiment), it is possible to quickly and easily alter the grounding schematic of the connector. As noted above in the example of an ATA cable assembly, each of the connectors 44*a,* 44*b,* 44*c* have a slightly different grounding scheme. Specifically, connector 44*a* has 40 signal contacts, a 40-position ground bus (first ground bus 52) and a 12-position ground bus (second ground bus 54); connector 44*b* has 39 signal contacts (one contact is removed from body 46, a 40-position ground bus (first ground bus 52) and an 11-position ground bus (second ground bus 54); connector 44*c* has 40 signal contacts, a 40-position ground bus (first ground bus 52) and an 11-position ground bus (second ground bus 54). In this particular example, the 11-position ground bus includes seven IDC features connected to signal contacts and four IDC features connected to the 40-position ground bus, while the 12-postion ground bus includes eight IDC features connected to signal contacts and four IDC features connected to the 40-position ground bus. The number of IDC features connecting to signal contacts and to the 40-position ground bus can easily be changed, depending upon the needs of the user. Because only the design of the second ground bus changes, it is not necessary to alter any other component of the connector, such as body 46, signal contacts 48, first ground bus 52 or cover 56, thereby greatly reducing the cost of manufacturing the connectors. In addition, the ground bus carrier functions to locate the signal contact IDC features 60 accurately and position the IDC features 60 properly with respect to cable 42, and further supports the IDC features to prevent buckling during cable termination. These and other advantages noted above provide a unique, reliable and cost effective connector for use in high speed electric connectors.

Although the invention has been described with respect to certain preferred embodiments, those skilled in the art will recognize that changes could be made without departing from the spirit and scope of the invention. For example, the connector could use other connection techniques known in the art, such as soldering, to replace the IDC features of the signal contacts and ground buses. Also, the first ground bus could be separated into multiple smaller units if, for example, more than one ground plane is required or desired. Likewise, the connector body and the ground carrier could be integrated into a single unit, depending upon the needs of the user. Accordingly, it is appropriate that the appended claims be construed broadly and in a manner consistent with the scope of the invention.

What is claimed is:

1. A connector for use with a multi-conductor ribbon cable, the connector comprising:

a connector body formed of a non-conductive material;

a plurality of signal contacts positioned within the connector body and adapted to electrically connect to a ribbon cable;

a ground carrier formed of a non-conductive material, the ground carrier positioned adjacent to the connector body and over the signal contacts;

a first ground bus positioned within the ground carrier and adapted to electrically connect to the ribbon cable;

a second ground bus positioned within the ground carrier and adapted to electrically connect to the ribbon cable; and a cover formed of a non-conductive material, the cover adapted for securing the ribbon cable against the signal contacts, the first ground bus and the second ground bus.

2. The connector of claim 1, wherein the first ground bus and the second ground bus each include an insulation displacement contact feature for electrical connection to a conductor of the ribbon cable.

3. The connector of claim 1, wherein the first ground bus electrically connects to alternate conductors of the ribbon cable.

4. The connector of claim 1, wherein the second ground bus electrically connects a first conductor of the ribbon cable to a second conductor of the ribbon cable, wherein the first conductor is electrically connected to one of the signal contacts and the second conductor is electrically connected to the first ground bus.

5. The connector of claim 1, wherein the signal contacts are positioned between the first ground bus and the second ground bus.

6. The connector of claim 1, wherein the first ground bus and the second ground bus are positioned in parallel alignment with the signal contacts.

7. The connector of claim 1, wherein the first ground bus and the second ground bus are received by longitudinal slots in the ground carrier.

8. The connector of claim 1, further comprising positioning grooves in the cover, the positioning grooves are sized to align with individual conductors of the ribbon cable.

9. The connector of claim 1, wherein the second ground bus comprises a plurality of ground jumpers.

10. The connector of claim 1, wherein the signal contacts each include an insulation displacement contact feature for electrical connection to a conductor of the ribbon cable.

11. The connector of claim 10, wherein the ground carrier is provided with openings for receiving the insulation displacement contact features of the signal contacts.

12. The connector of claim 11, wherein the insulation displacement contact features of the signal contacts are supported by and extend through the openings in the ground carrier.

13. The connector of claim 1, wherein the plurality of signal contacts electrically connect to a first set of conductors in the ribbon cable, the first set of conductors comprising alternate conductors of the ribbon cable.

14. The connector of claim 13, wherein the first ground bus is electrically connected to a second set of conductors in the ribbon cable, the second set of conductors comprising alternate conductors of the ribbon cable, wherein the conductors of the first set are positioned between the conductors of the second set.

15. A cable assembly comprising:

a ribbon cable having a plurality of conductors; and at least one connector, the at least one connector comprising:

a connector body;

a plurality of signal contacts positioned within the connector body;

a ground carrier attached to the connector body;

a first ground bus positioned within the ground carrier;

a second ground bus positioned within the ground carrier; and a cover for securing the ribbon cable to the connector.

16. The cable assembly of claim 15, wherein the second ground bus electrically connects a first conductor of the plurality of conductors to a second conductor of the plurality of conductors, wherein the first conductor is electrically connected to one of the signal contacts and the second conductor is electrically connected to the first ground bus.

17. The cable assembly of claim 15, wherein the signal contacts are positioned between the first ground bus and the second ground bus.

18. The cable assembly of claim 15, wherein the second ground bus comprises a plurality of ground jumpers.

19. The cable assembly of claim 15, wherein the plurality of signal contacts electrically connect to a first set of conductors in the ribbon cable, the first set of conductors comprising alternate conductors of the ribbon cable.

20. The cable assembly of claim 19, wherein the first ground bus is electrically connected to a second set of conductors in the ribbon cable, the second set of conductors comprising alternate conductors of the ribbon cable, wherein the conductors of the first set are positioned between the conductors of the second set.

21. A connector for use with a multi-conductor ribbon cable, the connector comprising:

a connector body;

a plurality of signal contacts aligned in a row within the connector body, and the signal contacts adapted to electrically connect to a ribbon cable;

a first ground bus positioned adjacent to the row of signal contacts, the first ground bus adapted to electrically connect to the ribbon cable;

a second ground bus positioned adjacent to the row of signal contacts, the second ground bus adapted to electrically connect to the ribbon cable; and a cover adapted for securing the ribbon cable against the signal contacts, the first ground bus and the second ground bus.

22. The connector of claim 21, wherein the first ground bus is positioned adjacent a first side of the row of signal contacts and the second ground bus is positioned adjacent a second side of the row of signal contacts.

23. The connector of claim 21, wherein the first ground bus and the second ground bus are positioned within the cover.

24. The connector of claim 21, wherein the first ground bus and the second ground bus are positioned within the connector body.

* * * * *